United States Patent [19]

Johnson

[11] 3,986,280

[45] Oct. 19, 1976

[54] APPARATUS FOR FORMING A CONCRETE WALL

[76] Inventor: Charles F. Johnson, 2039 E. Broadway Road, Apt. 163, Tempe, Ariz. 85281

[22] Filed: Apr. 7, 1975

[21] Appl. No.: 565,813

[52] U.S. Cl. ..... 37/80 A; 37/98; 37/DIG. 16

[51] Int. Cl.[2] ..... E02F 5/02; E02F 5/14

[58] Field of Search ..... 37/98, 83, 80 A, 86, 37/80 R, 117.5, DIG. 16; 172/194, 196; 61/39

[56] References Cited

UNITED STATES PATENTS

| | | | |
|---|---|---|---|
| 828,537 | 8/1906 | Daughters | 37/80 A |
| 953,226 | 3/1910 | Pontius | 37/DIG. 16 |
| 1,343,081 | 6/1920 | Hammen | 37/80 A |
| 2,196,513 | 4/1940 | Adler | 37/80 A |
| 2,223,608 | 12/1940 | George | 37/DIG. 16 |
| 2,551,883 | 5/1951 | Hunkler | 37/98 |
| 2,602,410 | 7/1952 | Vaughn | 37/80 A |
| 2,618,081 | 11/1952 | Sinner, et al. | 37/98 |
| 2,940,190 | 6/1960 | Meyer et al. | 37/DIG. 16 |
| 3,235,982 | 2/1966 | Krohn | 37/80 R |
| 3,286,377 | 11/1966 | Long | 37/118 R |
| 3,768,266 | 10/1973 | Glenn | 61/39 X |

*Primary Examiner*—Edgar S. Burr
*Assistant Examiner*—Steven A. Bratlie
*Attorney, Agent, or Firm*—Cahill, Sutton & Thomas

[57] ABSTRACT

A method and apparatus is disclosed wherein a trencher digs a trench in the ground which forms a mold for plastic concrete which, when set, comprises a concrete wall. An arm extends into the trench behind the trencher and is secured to a scoring tool; the scoring tool includes a scoring plate having a pattern formed in one edge thereof. The scoring plate is urged into a wall of the trench and forms a negative of a decorative pattern as the scoring tool is transported along the trench by the trencher. Plastic concrete is then poured into the trench; when the concrete is set, a portion of the soil is removed to expose the decorative pattern formed in the concrete.

5 Claims, 5 Drawing Figures

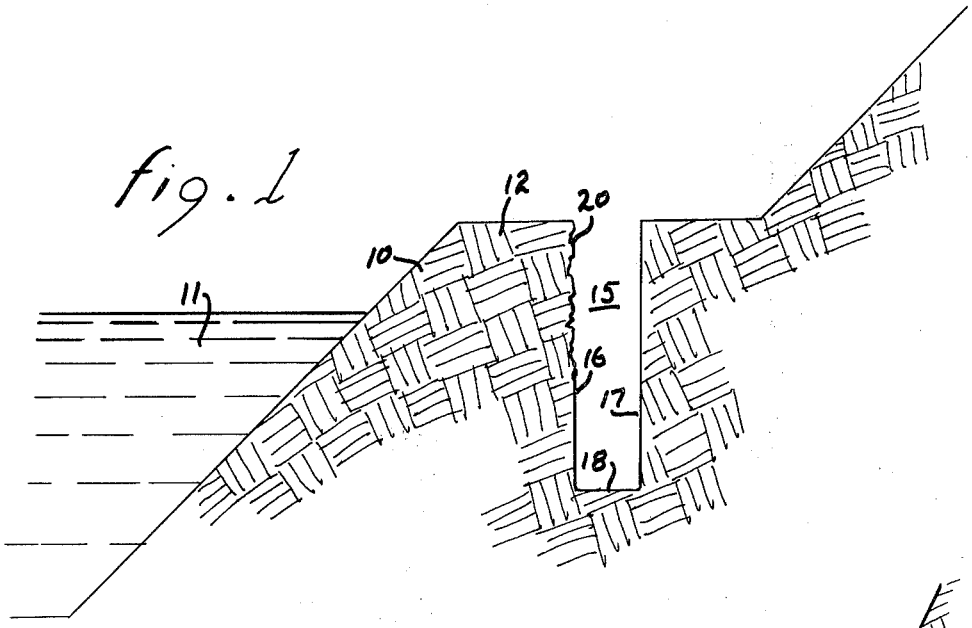
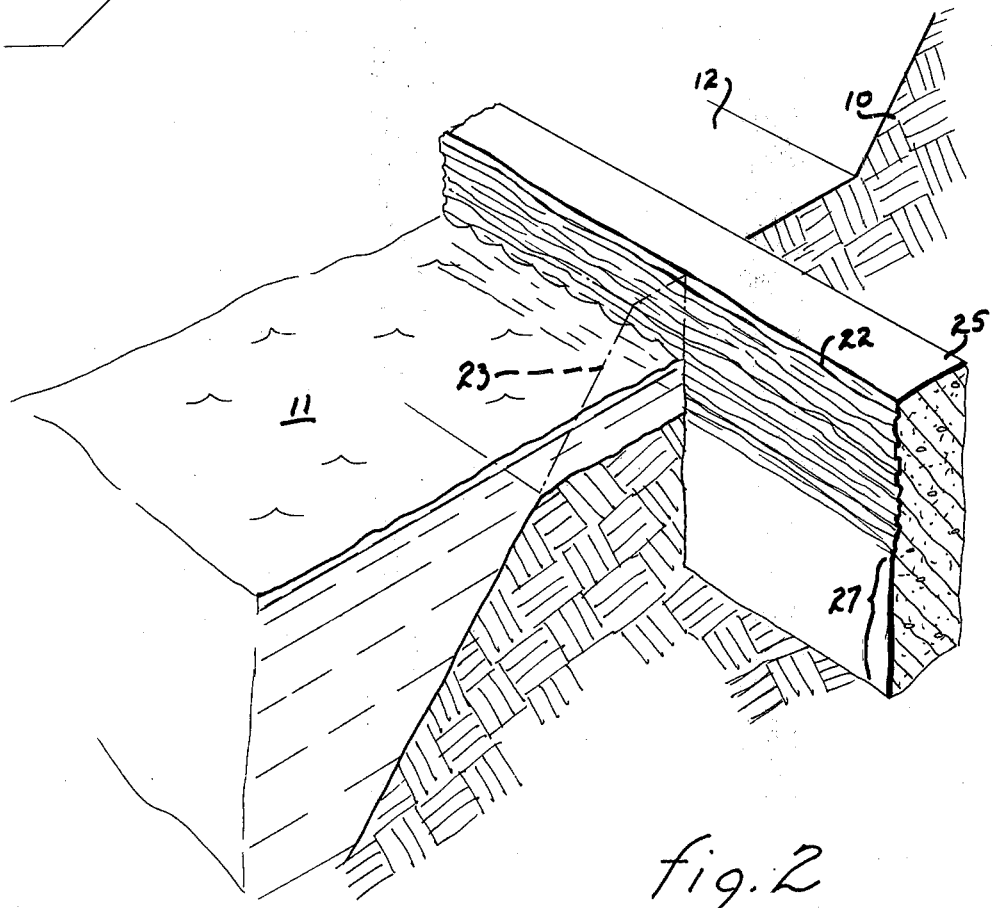
fig. 2

APPARATUS FOR FORMING A CONCRETE WALL

The present invention pertains to methods and apparatus for forming a concrete wall, and more particularly, to the method and apparatus of forming a wall having a pattern simulating natural, stratified rock.

In many applications, it is desirable to provide a wall which is inexpensive but nevertheless attractive. Walls have previously been formed by digging a trench and subsequently using the trench as a mold to receive plastic concrete. When the concrete has set, the soil is removed from one or both sides, thereby exposing the concrete and forming a wall. This method of forming a wall is inexpensive and particularly useful where the excavation is already required on at least one side of the proposed wall such as where the wall will act as a retaining wall.

Unfortunately, such walls are often crude in appearance and generally unacceptable in locations that are exposed to public viewing. The only alternative in such cases, is to form the wall using conventional masonry techniques, including trenching and pouring concrete for a footer and completing the construction with concrete block or the like. Such alternative techniques are extremely expensive. Another alternative is the utilization of a slip-formed concrete wall; however, slip-forming also requires trenching to provide a footer as well as requiring large cumbersome and expensive equipment. As a result of such expense, it is usually not economically feasible to use slip-forming techniques except under very specific circumstances such as highway median barriers.

In both of the above-mentioned alternative techniques, the walls must first be constructed and the soil back filled against the wall when the wall is to be used as a retaining wall.

It is therefore an object of the present invention to provide a method and apparatus for inexpensively forming a concrete wall.

It is another object of the present invention to provide a method and apparatus for forming a concrete wall having a decorative pattern thereon which renders the wall acceptable in those applications where the wall is exposed to public viewing.

It is still another object of the present invention to provide a method and apparatus for forming a concrete wall by trenching and incorporating a negative of a decorative pattern in the trench to give the wall a natural, stratified rock appearance.

These and other objects of the present invention will become apparent to those skilled in the art as the description thereof proceeds.

Briefly, in accordance with the embodiment chosen for illustration, a trencher is utilized to dig a trench in the ground; as the trench is being dug, a towing arm is extended into the trench. A scoring plate having a pattern formed along one edge thereof is urged against one wall of the trench by a coil spring positioned between the scoring plate and a shoe positioned against the opposite trench wall. The scoring plate is mounted on an arm pivotally secured to a hinge pin which in turn is attached to the towing arm. A pair of flexible cables, together with clamps on the hinge pin and towing arm form a flexible connection between the hinge pin and the towing arm to give the scoring plate limited freedom of movement as it is towed behind the trencher. The scoring plate is provided with a positive of the decorative pattern and therefore forms a negative of the decorative pattern in the wall of the trench. Concrete is subsequently poured in the trench and after it has set, the soil is removed from at least one side of the wall to expose the decorative pattern. The wall thus appears as natural, stratified rock and provides a pleasing appearance to an otherwise inexpensive concrete wall.

The present invention may more readily be described by reference to the drawings in which:

FIG. 1 is a cross-sectional view of a trench useful in describing the method and apparatus of the present invention.

FIG. 2 is an isometric view, partly in section, of a wall formed in accordance with the teachings of the present invention.

Figure 3:
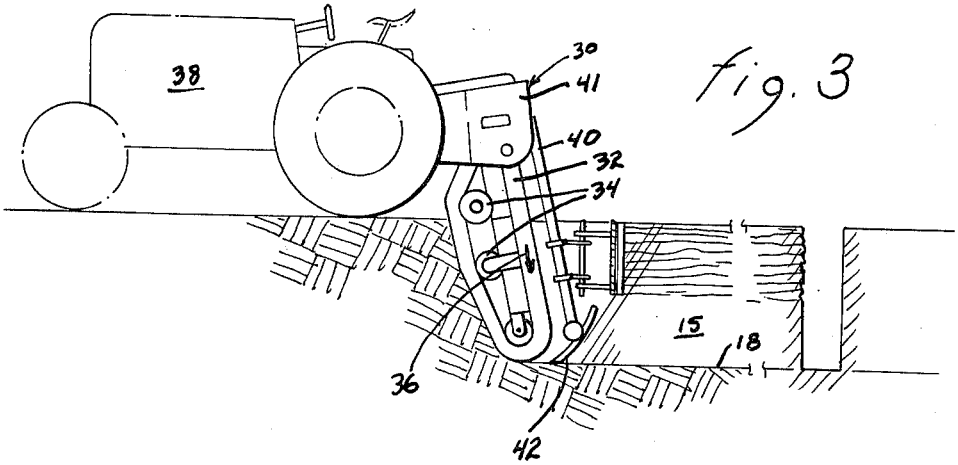
FIG. 3 is a side-elevational view, partly in section, of a trench being formed in accordance with the teachings of the present invention.

Referring now to FIGS. 1 and 2, the present invention will be described in an environment wherein a retaining wall is desired bordering an artificial lake. As shown in FIG. 1, the ground 10 adjacent the lake 11 is sloping; a bench 12 may be provided to accommodate a trencher to form a trench 15. The trench includes walls 16 and 17 and a bottom 18 forming a mold to receive plastic concrete that will ultimately form the desired retaining wall. The wall 16 has been scored to provide a negative pattern 20 of natural, stratified rock. Plastic concrete is then poured into trench 15 and allowed to set. The concrete conforms to the shape of the trench 15 and, when set, includes a positive pattern 22 simulating naturally occurring stratified rock. A portion of the ground or soil, shown in broken lines in FIG. 2 at 23, is then removed to expose that portion of the wall 25 having the pattern 22 thereon. It may be noted that a sufficient portion 27 of the wall 25 remains in the ground to provide suitable footing for the wall. While the wall shown in FIGS. 1 and 2 is positioned to permit the water 11 to contact one surface thereof, it will be obvious to those skilled in the art that the water level need not be high enough to contact the wall; it will also be obvious to those skilled in the art that both sides of the wall may be provided with the pattern 22 and both sides of the wall subsequently exposed when the wall is not to be used in a retaining application.

Referring now to FIG. 3, a trencher shown generally at 30 may be a conventional trenching machine such as a Ditch Witch R 65 manufactured by the Charles Machine Works. Such trenching machines characteristically include a conveyor system 32 supported on suitable roller mounts 34 and incorporate scraper or buckets (not shown) which are continuously driven on the conveyor system in the direction indicated in FIG. 3 by the arrow 36. The scrapers or buckets continuously scrape and lift soil as the trencher slowly travels along the surface of the ground.

The trencher is mounted on a vehicle 38 and is guided by the vehicle along the path of the trench to be dug. Such trenchers usually include an optional device for removing particles of dirt or rocks that either fall into the trench or remain in the trench after the scrapers or buckets have passed. Such devices are commonly referred to as crumbers. A typical crumber is shown in FIG. 3 and includes a boom 40 which is rigidly fixed to the framework 41 of the trencher; the boom extends into the trench and supports a scoop 42 mounted on the bottom extremity of the boom. The scoop 42 either rides on the bottom 18 of the trench or is supported in close proximity to the bottom 18. Rocks and dirt in front of the scoop 42 are collected by the scoop and forced into the scrapers or buckets on the conveyor 32 to be transported upwardly out of the trench. In practice, the scoop 42 may be positioned slightly to the rear to catch dirt that is loosened during the scoring of the trench as will be described more fully hereinafter.

The boom 40 may be conveniently used as a towing arm for the apparatus to be described in connection with FIGS. 4 and 5. If a crumber is not available, a towing arm may be constructed of any relatively rigid angle iron, tube or box section steel fixedly secured to the trencher and extending downwardly into the trench behind the conveyor 32.

Figure 4:
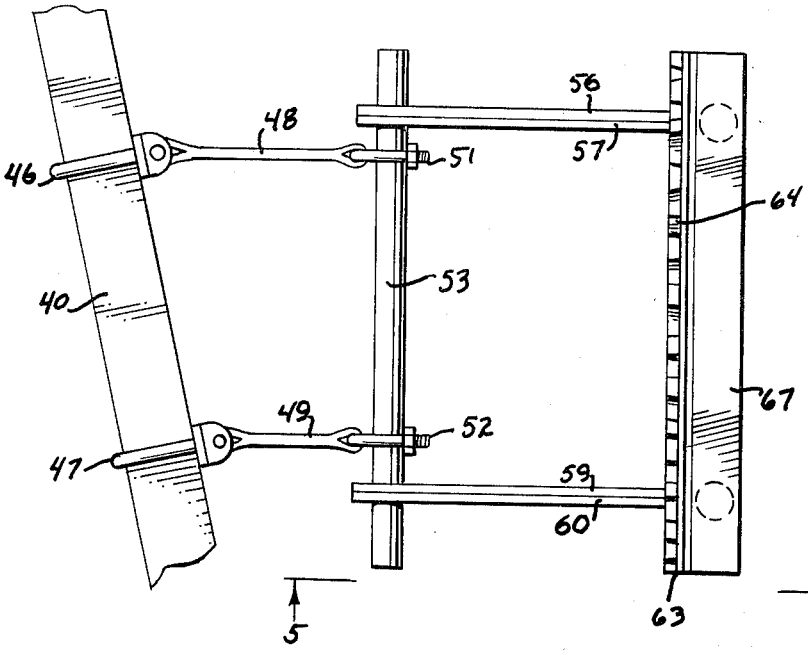
FIG. 4 is a side-elevational view of apparatus constructed in accordance with the teachings of the present invention.
Figure 5:
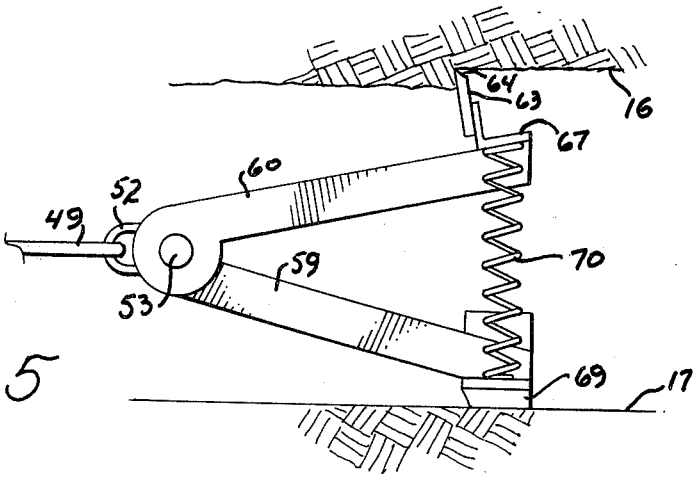
FIG. 5 is a view of a portion of FIG. 4 taken along line 5—5.

Referring now to FIGS. 4 and 5, the boom 40 is shown having a pair of clamps 46 and 47 secured thereto. A pair of flexible cables 48 and 49 are shown pivotally attached to the clamps 46 and 47, respectively. The cables 48 and 49 may be formed of conventional, braided steel cable or may alternatively be constructed of conventional steel chain or solid steel bars having suitable pivot connections on either end. A pair of clamps 51 and 52 are mounted on a hinge pin 53 and are connected to the opposite ends of cables 48 and 49, respectively.

An upper pair of arms 56 and 57 are pivotally mounted on the hinge pin 53; similarly, a lower pair of arms 59 and 60 are also pivotally mounted on the hinge pin 53. The arms 56, 57, 59 and 60 extend from the hinge pin 53 and form an angle with the side walls 16 and 17 of the trench. A scoring plate 63 is provided with a tooth-like pattern 64 along one edge, which pattern is a positive of the cross-section of the decorative pattern 22 to be formed in the wall. The scoring plate 63 is secured to the end of the arms 57 and 60 by any convenient means such as by welding to an angle iron 67 which in turn is welded to the arms. A shoe 69, formed in any convenient manner such as a flat steel bar, is secured such as by welding, to the ends of arms 56 and 59.

The scoring plate 63 is urged against the wall 16 by coil spring 70 extending between angle iron 67 and shoe 69.

In operation, the trencher proceeds along a predetermined path and provides a trench having a predetermined width and depth. The boom 40 extends into the trench and pulls the scoring plate 63 along with the trencher. The scoring plate 63 is allowed limited freedom of movement through the expediency of flexible cables 48 and 49; such freedom of movement provides a more natural appearing, randomly oriented striations in the resulting wall. The flexible cables 48 and 49 are made short enough to prevent the scoring plate 63 from travelling vertically a sufficient distance to completely disengage the trench wall or descend into the trench to leave a significant unpatterned portion along the top of the wall. While the present invention has been described in terms of forming a decorative pattern on one side of a concrete wall, it will be obvious to those skilled in the art that the shoe 69 could be replaced with a second scoring plate to provide a decorative pattern on both sides of the wall.

I claim:

1. Apparatus for scoring the wall of a trench as it is transported along said trench to provide a negative of a decorative pattern, said trench having two walls and a bottom forming a mold to receive plastic concrete, said apparatus comprising:

a. a scoring plate having a pattern formed along one edge thereof, said pattern being a positive of a cross-section of said decorative pattern;

b. means supporting said plate in a trench with said one edge in a vertical plane and engaging a wall of said trench, said supporting means including:

i. a hinge pin extending substantially vertically in said trench;

ii. a pair of arms mounted on said hinge pin for pivotal movement thereabove and extending from said pin at an angle toward the walls of said trench;

iii. means securing said plate to one of said arms for contacting one wall of said trench;

iv. means secured to the other of said arms for contacting the other trench wall; and v. means acting between said pair of arms forcing said arms apart to force said one edge into said one wall;

c. a towing arm extending into said trench; and d. a plurality of flexible members connecting said towing arm to said means supporting said plate whereby a negative of the decorative pattern is formed in a wall of said trench.

2. The apparatus of claim 1, wherein said means forcing said one edge into said wall comprises a spring urging said arms apart.

3. The apparatus of claim 1, wherein said means secured to the other of said arms comprises a shoe for contacting the other trench wall.

4. The apparatus of claim 1, wherein said means secured to the other of said arms comprises a second scoring plate for scoring the other trench wall.

5. The apparatus of claim 1, wherein said means secured to the other of said arms comprises a shoe for contacting the other trench wall, and wherein said means forcing said one edge into said wall comprises a coil spring extending between said shoe and said scoring plate.

* * * * *